United States Patent [19]

Chevalier

[11] 4,146,818

[45] Mar. 27, 1979

[54] ELECTRON GUN

[75] Inventor: Jacques Chevalier, Paris, France

[73] Assignee: Thomson-CSF, Paris, France

[21] Appl. No.: 805,822

[22] Filed: Jun. 13, 1977

[30] Foreign Application Priority Data

Jun. 15, 1976 [FR] France ..... 76 18123

[51] Int. Cl.[2] ..... H01J 29/56; H01J 29/46

[52] U.S. Cl. ..... 315/15; 313/449; 315/382

[58] Field of Search ..... 313/448, 449, 414; 315/15, 382

[56] References Cited

U.S. PATENT DOCUMENTS

| | | | |
|---|---|---|---|
| 2,852,716 | 9/1958 | Lafferty | 315/15 |
| 2,935,636 | 5/1960 | Knechtli | 315/15 X |
| 3,852,608 | 12/1974 | Johanns et al. | 313/449 |
| 3,962,599 | 6/1976 | Say | 313/449 |

*Primary Examiner*—Robert Segal
*Attorney, Agent, or Firm*—Roland Plottel

[57] ABSTRACT

An electron gun comprising in succession in a vacuum envelope an electron source electrode or cathode, a control grid electrode, a first accelerating electrode or anode and a first and second focussing electrode. It further comprises connections for subjecting in operation each electrode to a polarizing voltage. The first focussing electrode is raised in operation to a polarizing voltage several tens of times higher than the polarizing voltage of the anode which precedes it and the second focussing electrode is raised in operation to a polarizing voltage several times higher than the polarizing voltage of the first focussing electrode which precedes it. The first focussing electrode and the anode form thus a prefocussing lens while the second focussing electrode and the first focussing electrode form a main lens.

9 Claims, 10 Drawing Figures

ELECTRON GUN

Figure 1:
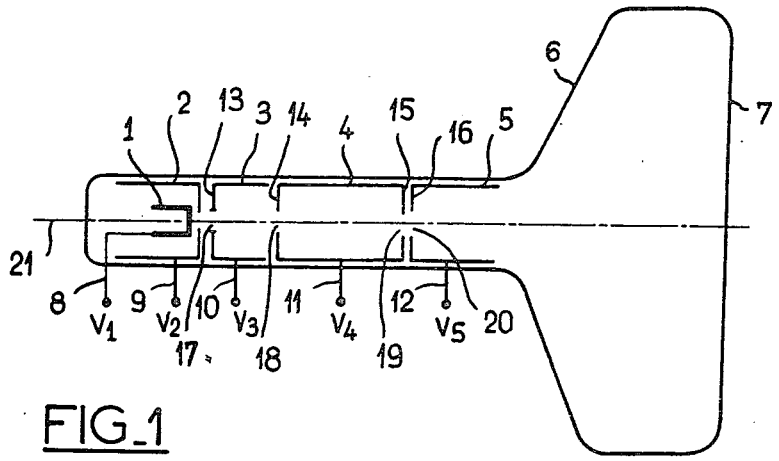

The present invention concerns the creation of electron guns for cathode ray tubes in which a small diameter electron beam giving uniform resolution over the whole screen is required.

The solutions which exist at present satisfy the requirement fixed in part. They use as a starting point a classical electron gun structure consisting of the following electrode arrangement: a flat cathode is associated with the current layout of a control grid which controls the cathode delivery; this is followed by a first accelerating electrode or anode and then by focussing electrodes.

An additional electrode, fitted near the cross over of the electron beam and placed between the first accelarating electrode and the fist electrode in the main focussing assembly, is then used to limit the beam divergence in one solution proposed.

Another solution consists in using a special electron gun called the Pierce gun which produces an only slightly divergent beam. Another solution, known as the monocon gun, also makes possible the production of an only slightly divergent beam but to the detriment of the gun's efficiency and transconductance.

The present solution makes it possible to satisfy the requirement fixed while at the same time avoiding the disadvantages stated.

The subject of the present invention concerns an electron gun for cathode ray tubes which comprises in succession an electron source electrode or cathode, a control electrode, a first accelerating electrode or anode, a first focussing electrode and a second focussing electrode, the said first and second focussing electrodes, which are raised respectively to a polarizing voltage several tens of times greater than and a polarizing voltage several times greater than the voltage on the preceding electrode, forming respectively a prefocussing lens and a main lens with this last electrode.

The device, which is the subject of the invention, by producing a small diameter electron beam from the cathode to the screen of the tube in which it is used, makes possible the use of a common deflecting device, the focussing and emission of the electron beam being carried out, in accordance with the invention, independently of the deviation mode chosen. A cathode ray tube, fitted with an electron gun complying with the invention, also gives constant resolution independently of the spot brilliance on the screen. An increase in spot brilliance by an increase in cathode delivery does not cause a change in the resolution of the screen in a tube fitted with a device complying with the invention as the increase in diameter of the cross over of the electron beam does not cause defocussing of its image at the cathode ray tube screen level.

Finally, for a well defined spot trace width on the screen, because a small diameter electron beam is obtained, the distribution of the luminous intensity as a function of the distance to the center of the spot occurs in accordance with an almost rectangular curve. This curve has a maximum near the spot centre and a sharp decrease in luminous intensity near the perceptible limits of the spot which, because of this, has no halo. Frame lining with a television type sweep, which consists in a classical tube in a blacked-out spacing of the lines due to their brilliance distribution, can be avoided by using a device complying with the invention.

Also, in accordance with the invention, the obtaining of a halo-free spot on the screen does not require the use of a diaphragm intended to limit the useful dimension of the luminous spot on the cathode ray tube screen.

The present invention also enables excellent gun efficiency to be obtained ensuring a good length of life for the cathode emitter.

Finally, a cathode ray tube fitted with an electron gun complying with the invention has uniform resolution over the whole screen as the small diameter of the beam makes it possible to minimize astigmatism and spot defocussing on the edge of the screen for a large beam deviation angle.

Cathode ray tubes fitted with an electron gun complying with the invention are usable in any application which requires the advantages stated for the tube and, in particular, in the graphic data presentation field and that of television and display receivers for telephones.

Figure 2:
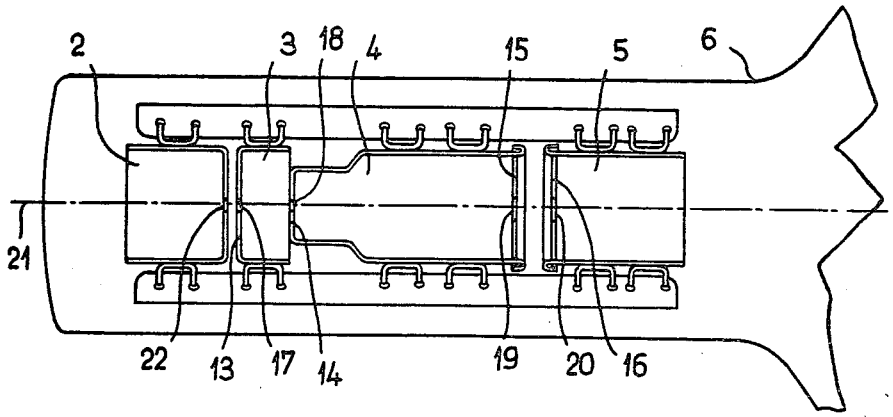
Figure 3:
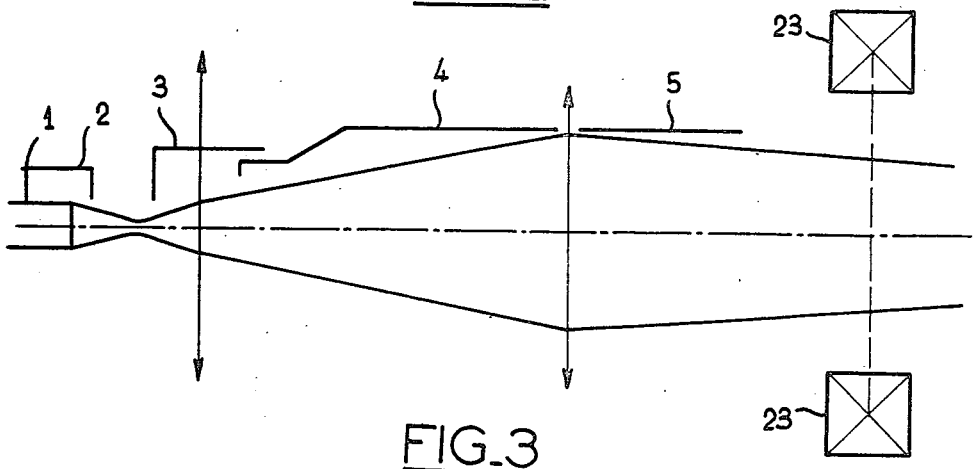
FIG 3 PRIOR ART
Figure 4:
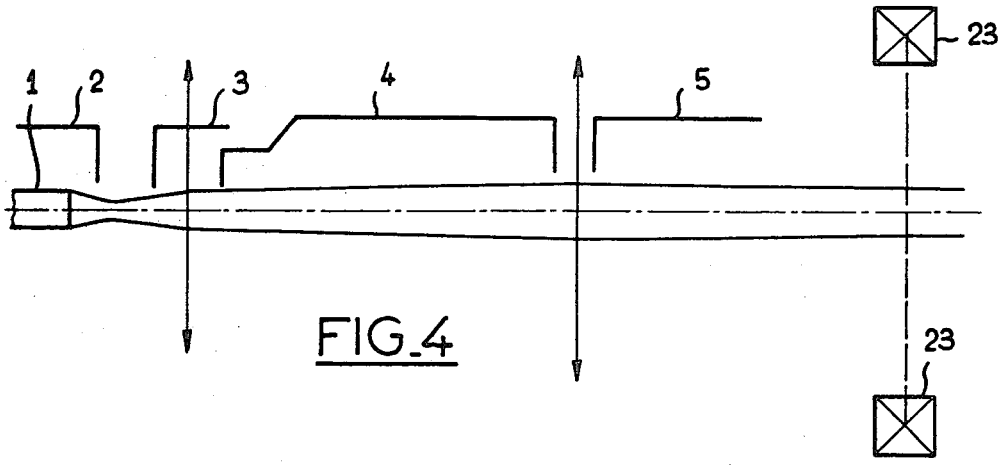
Figure 5:
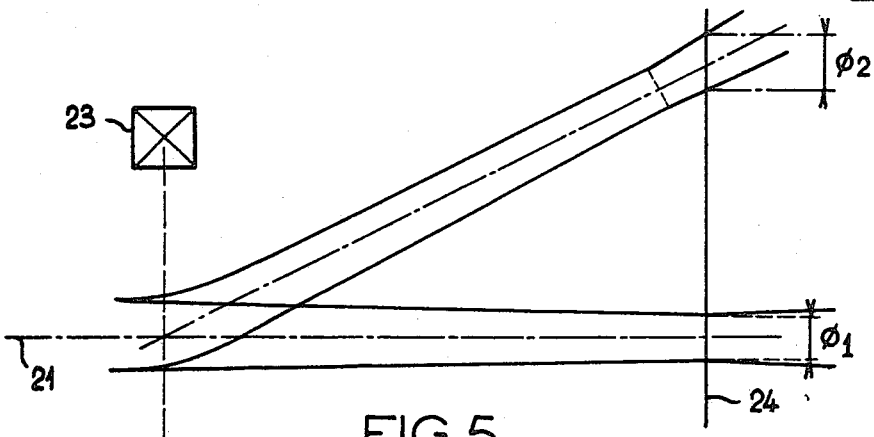
Figure 6:
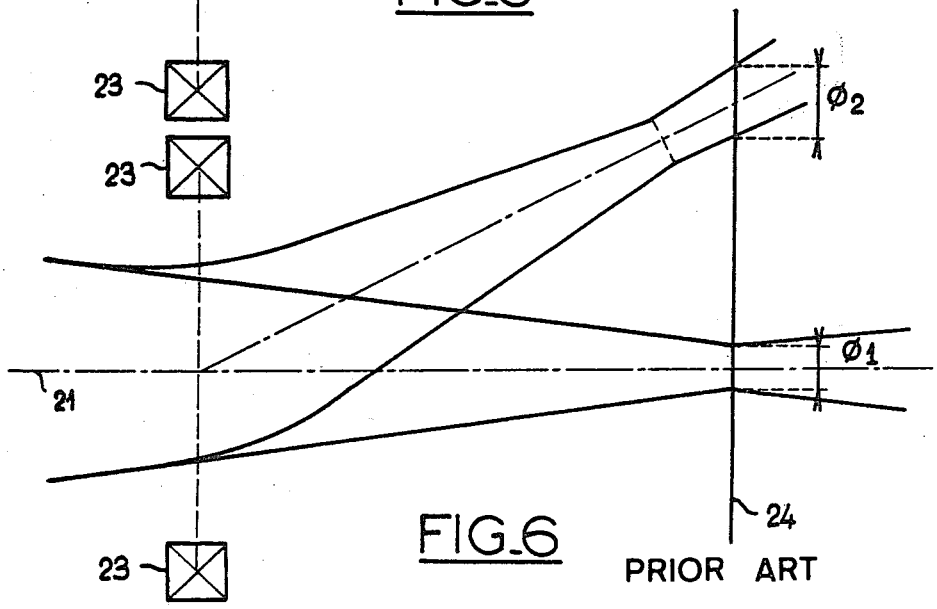
FIG 6 PRIOR ART
Figure 7:
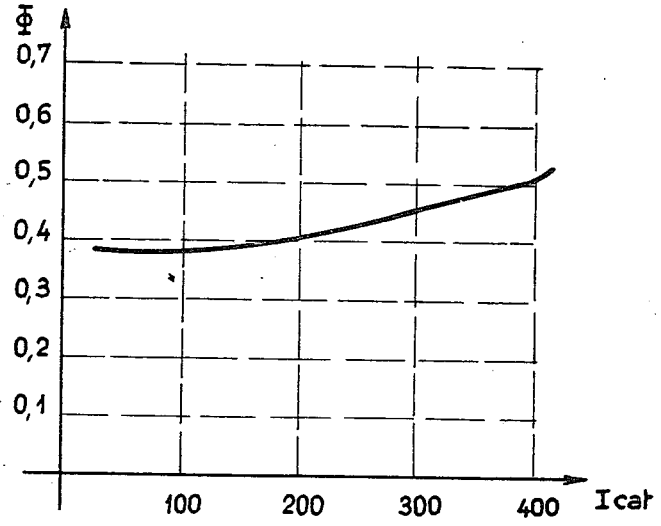
Figure 8:
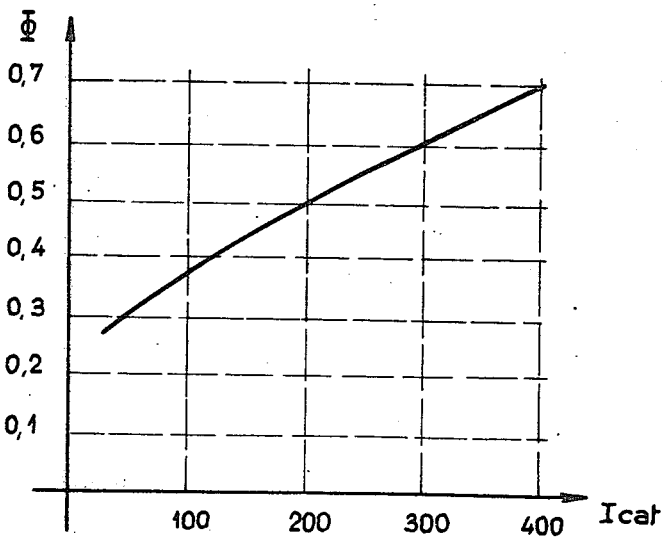
FIG 8 PRIOR ART
Figure 9:
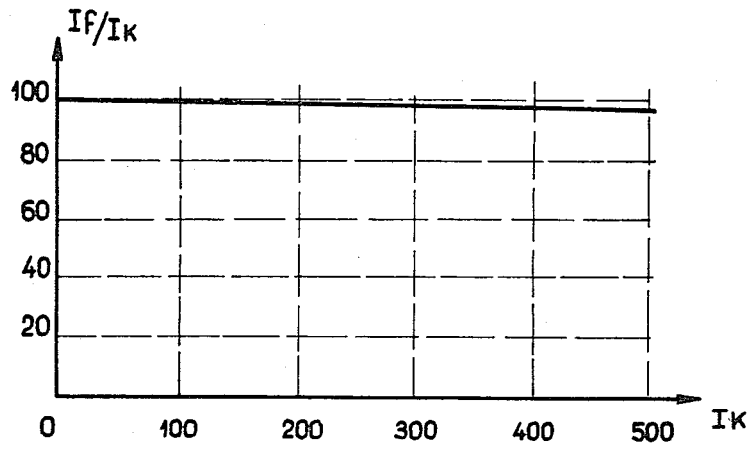
Figure 10:
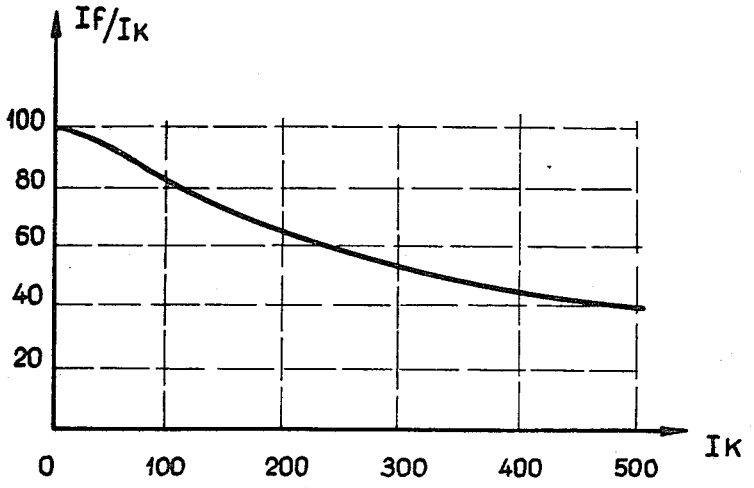
FIG.10 PRIOR ART

The invention will be better understood by means of the following description and the drawings in which the same references apply to the same elements where:

FIG. 1 shows a cathode ray tube fitted with an electron gun complying with the invention, FIG. 2 shows an embodiment of the subject of the invention, FIGS. 3 and 4 show a drawing of electron beams obtained in a classical cathode ray tube and in a cathode ray tube complying with the invention respectively, FIGS. 5 and 6 show comparative drawings of the defocussing and astigmatism in a cathode ray tube fitted with an electron gun complying with the invention and a classical cathode ray tube respectively when there are big deviations of the electron beam, FIGS. 7 and 8 show a curve of the variation in spot diameter as a function of cathode current on the screen of a cathode ray tube fitted with an electron gun complying with the invention and a cathode ray tube fitted with a classical electron gun respectively, FIGS. 9 and 10 show a gun efficiency curve for an electron gun complying with the invention and a classical electron gun respectively.

The cathode ray tube shown in FIG. 1 contains in a vacuum glass envelope 6 fitted with a screen 7 a succession of electrodes where electrode 1 is an electron source or cathode emitter, electrode 2 a control electrode, electrode 3 the first acceleration electrode or anode and electrodes 5 and 6 focussing electrodes. In operation each electrode is subjected to a polarizing voltage, V1, V2, V3, V4 and V5 respectively through the corresponding connections 8, 9, 10, 11 and 12.

In accordance with the invention, a prefocussing of the electron beam, which makes it possible to obtain a small diameter beam throughout its length and a small slope of the rays with respect to the beam axis, is obtained by the use of a first prefocussing lens and then a second or main lens. The prefocussing lens is formed by electrodes 3 and 4 to which polarizing voltages V3 and V4 are applied in operation in a high voltage ratio V4/V3 greater than 15. The second lens is formed by electrodes 4 and 5 to which polarizing voltages V4 and V5 are applied in operation in a low voltage ratio V5/V4 less than 4. The electrode of anode 3 has a flat face or preferably a flat input disc 13 pierced in its center by a circular orifice 17 and the first focussing electrode 4 has a flat face or preferably a flat input disc 14 also with a circular hole pierced in its center. Input discs 13 and 14 of electrodes 3 and 4 are parallel to one another and orthogonal to the electron beam axis 21 which passes through their centre. The first focussing electrode 4 has a flat face or preferably a flat output disc 15 and the second focussing electrode 5 a flat face or preferably a flat input disc 16. The two discs, 15 and 16, each pierced at its center by a circular orifice 19 and 20, are parallel one to another and orthogonal to the electron beam axis 21 which passes through their centre. The first prefocussing lens is formed by parallel discs 13 and 14 of electrodes 3 and 4 with their orifices and the second lens or main lens is formed by parallel discs 15 and 16 of electrodes 4 and 5 with their orifices.

Voltage ratio V5/V4 is small compared with voltage ratio V4/V3. However, because of its geometrical construction, the power of the said second lens is adequate to ensure the main focussing. Input orifice 18 of electrode 4 is formed by a small diameter circular hole. This causes a curving of the field lines and a concentration of the beam at its level. The second or main lens thus forms on the screen the image of an object whose position and diameter vary little with the cathode delivery thus ensuring a small variation of the spot dimension on the screen. The electron beam deviation is obtained with any classical deflecting device which is not shown on FIG. 1.

In accordance with the particular embodiment of the invention shown in FIG. 2 electrodes 2 and 3 are pierced by a circular hole of the same diameter as in the case of a classical gun. In accordance with the particular embodiment input disc 14 of electrode 4 is fitted with a circular hole 18 whose diameter, of the same order of size as that of the electron beam which passes through it, is very much smaller than that of the orifices in the preceding electrodes 2 and 3. The distance between electrodes 3 and 4 is that of the corresponding electrodes in a classical electron gun. The diameter of orifice 19 in output disc 15 of electrode 4 is of the same order of size as that of the beam diameter. Input disc 16 of electrode 5 is fitted with a circular hole 20 whose diameter is about that of orifice 19 in output disc 15 of electrode 4. The distance between discs 15 and 16 of electrodes 4 and 5 is of the order of two to three times the dimension of orifice 19 in output disc 15 of electrode 4.

In accordance with the particular but non-limiting embodiment shown in FIG. 2, electrodes 2 and 3 are pierced by a circular hole 0.7 millimeter in diameter, the diameter of hole 18 in input disc 14 of electrode 4 is 0.4 millimeter and the distance between discs 13 and 14 of electrodes 3 and 4 is about 6 millimeters. The diameter of orifice 19 in output disc 15 of electrode 4 is then about 0.9 millimeter which enables a beam diameter of about the same size to be obtained for high values of the cathode current. The distance between discs 15 and 16 of electrodes 4 and 5 is about 2 millimeters.

The polarizing voltages on the various electrodes are then:

Cathode voltage : V1 = 0 V
Grid voltage : V2 < 0 V
First accelerating anode voltage : V3 = 250 V
Electrode 4 voltage : V4 = 5000 V
Electrode 5 voltage : V5 = 14000 V The use in focussing of the second lens or main lens with two holes enables a low voltage ratio V5/V4 to be obtained, V5/V4 being 2.8 in the example given, while preserving for the said lens its focussing properties due to its geometrical shape.

A lens with two holes is mainly formed by two parallel conducting planes each pierced by a small diameter orifice, the latter being opposite one another. The distance between the parallel planes forming the lens is not more than two or three times the dimension of the orifices.

Due to this, potential V5 is chosen in a ratio V5/V4 which is low for reasons other than those of screen brilliance and potential V4 is increased with respect to the potential of the corresponding electrode in a classical tube.

Voltage ratio V4/V3 in the example given is then 20. This ratio, which is about 9 in a cathode ray tube fitted with a classical type gun, is here much higher and the lens formed by electrodes 3 and 4 is much more efficient in operation than that in a classical gun.

The prefocussing action thus obtained generates an electron beam of much smaller diameter. In the particular embodiment example, the electron beam diameter at the deflecting device level is half that for a normal electron gun.

The theory of electron beam focussing in accordance with the invention is shown in FIG. 4. The prefocussing lens formed by electrodes 3 and 4, because of its optical properties, makes possible a modification of the spot brilliance distribution in a pseudo-rectangular brilliance intensity distribution curve and results in an increase in gun efficiency while making unnecessary the use of a diaphragm to suppress the halo. At the level of the deflecting device 23, the electron beam diameter is half that of a normal electron gun shown in FIG. 3, thus reducing astigmatism and spot defocussing faults on the screen for big beam deviations.

In accordance with FIG. 5, the focussing of cathode rays into a beam of small diameter and small slope with respect to axis 21 of the electron beam makes it possible to maintain a spot trace of diameter $\phi 2$ little different from the minimum diameter $\phi 1$ of the spot at the screen centre 24 for extreme beam deviations. In the case of the electron beam in a classical tube shown in FIG. 6, the slope of the rays with respect to their direction of propagation gives, for large beam deviations, a spot diameter $\phi 2$ much greater than the diameter $\phi 1$ of the spot at the center of screen 24.

The curves as in FIG. 7 and FIG. 8 representing the spot diameter $\phi$ as a function of cathode current for a tube fitted with an electron gun complying with the invention and for a classical tube respectively have their ordinate axes gratuated in millimeters and their abscissa axes in microamperes. FIGS. 7 and 8 show that a reduction in spot diameter variation as a function of cathode current is obtained by the use of the device which is the subject of the invention. The mean slope of the curve, about $11 \times 10^{-4}$ millimeter per microampere for a classical tube, is reduced to much less than $3 \times 10^{-4}$ millimeter per microampere for a tube fitted with an electron gun complying with the invention.

As far as the efficiency of an electron gun complying with the present invention is concerned, the relative efficiency with respect to the efficiency of electron guns for low cathide currents less than 50 microamperes is virtually maintained for high values of the latter contrary to the relative efficiency of a classical type electron gun. The efficiency curve for an electron gun complying with the invention, shown in FIG. 9, and that for a classical type electron gun, shown in FIG. 10, have their ordinate axes graduated in percentage of the ratio of beam current If to cathode current Ik.

Of course, the invention is not limited to the embodiment described and shown which was given solely by way of example.

What is claimed, is:

1. An electron gun in a vacuum envelope for generating an electron beam, said electron gun comprising in succession:

an electron source electrode;

a control grid electrode;

a first accelerating electrode;

a first focussing electrode, the first accelerating electrode and the first focussing electrode/each comprising an input disc pierced at its center by a circular hole, said discs being arranged perpendicularly to the axis of the electron beam passing through their center;

a second focussing electrode, the first focussing electrode and the second focussing electrode comprising respectively an output disc and an input disc pierced at its centre by a circular hole, said discs being arranged perpendicularly to the axis of the electron beam passing through their center, the output disc of the first focussing electrode and the input disc of the second focussing electrode being at a distance from one another less than three times the diameter of the hole in the output disc of the first focussing electrode;

polarizing voltage means for applying to each electrode a polarizing voltage, said first focussing electrode being raised, by the polarizing voltage means, to a polarizing voltage $V_4$ several tens of times higher than the polarizing voltage $V_3$, applied by the said means, to the first accelerating electrode, these two electrodes forming thus a prefocussing lens; and said second focussing electrode being raised, by the polarizing voltage means, to a polarizing voltage $V_5$ several times higher than the polarizing voltage $V_4$, applied to the first focussing electrode, these two electrodes forming thus a main focussing lens.

2. An electron gun as claimed in claim 1, wherein the ratio of the polarizing voltage $V_4$ to the polarizing voltage $V_3$, V4/V3, is greater than 15.

3. An electron gun as claimed in claim 2 wherein the hole on the input disc of the first focussing electrode has a diameter about the size of the electron beam which passes through it.

4. An electron gun as claimed in claim 1, wherein the ratio of the polarizing voltage $V_5$ to the polarizing voltage $V_4$, V5/V4, is less than 4.

5. An electron gun as claimed in claim 4 wherein said output disc of the first focussing electrode and input disc of the second focussing electrode form a two hole lens.

6. An electron gun according to claim 3 wherein the ratio of the polarizing voltage V5 to the polarizing voltage V4, V5/V4, is less than 4.

7. An electron gun according to claim 6 wherein the holes in said input discs of said first accelerating electrode and said first focusing electrode respectively have diameters of approximately 0.7 and 0.4 mm; and the distance between said discs is about 6 mm; and the hole in said output disc of said first focusing electrode is about 0.9 mm; and the distance between said discs of said first and second focusing electrodes is about 2 mm.

8. An electron gun according to claim 7 wherein said polarizing voltages are relative to ground on said electron source electrode; a negative on said grid electrode; about 250 v on said first accelerating electrode; about 5000 v on said first focusing electrode and about 14,000 v on said second accelerating electrode.

9. An electron gun according to claim 7 wherein the hole of the input disc of the second focusing electrode has a diameter of about 0.9 mm.

* * * * *